US010711365B2

(12) United States Patent
Hosokawa

(10) Patent No.: US 10,711,365 B2
(45) Date of Patent: Jul. 14, 2020

(54) PLATING APPARATUS AND PLATING METHOD

(71) Applicant: Murata Manufacturing Co., Ltd., Nagaokakyo-shi, Kyoto-fu (JP)

(72) Inventor: Takao Hosokawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 16/218,528

(22) Filed: Dec. 13, 2018

(65) Prior Publication Data

US 2019/0112728 A1 Apr. 18, 2019

Related U.S. Application Data

(63) Continuation of application No. PCT/JP2017/019748, filed on May 26, 2017.

(30) Foreign Application Priority Data

Jun. 16, 2016 (JP) ..... 2016-119564

(51) Int. Cl.
*C25D 17/02* (2006.01)
*C25D 21/08* (2006.01)
(Continued)

(52) U.S. Cl.
CPC ..... *C25D 17/02* (2013.01); *C23G 3/00* (2013.01); *C25D 5/08* (2013.01); *C25D 5/12* (2013.01);
(Continued)

(58) Field of Classification Search
CPC ..... C25D 17/16–18
See application file for complete search history.

(56) References Cited

U.S. PATENT DOCUMENTS

2005/0217989 A1* 10/2005 Hradil ..... C25D 17/22 204/201

FOREIGN PATENT DOCUMENTS

JP 10-212596 A 8/1998
JP 2007-051378 A 3/2007
(Continued)

OTHER PUBLICATIONS

Official Communication issued in International Patent Application No. PCT/JP2017/019748, dated Jun. 20, 2017.

*Primary Examiner* — Brian W Cohen
*Assistant Examiner* — Ho-Sung Chung
(74) *Attorney, Agent, or Firm* — Keating & Bennett, LLP

(57) ABSTRACT

A plating apparatus includes a plating tank and a plating unit that performs electrolytic plating on an object. The plating unit includes a workpiece passage region including a partition wall that allows passage of the plating solution but does not allow passage of the object, the workpiece passage region passing the object from above toward below, an injection unit that injects the plating solution from below toward above, a mixing unit that mixes the plating solution injected by the injection unit and the object to be plated passing through the workpiece passage region, an anode outside the workpiece passage region, a cathode inside the workpiece passage region including a hollow region through which a mixed fluid of the plating solution and the object to be plated passes from below toward above, and a guidance unit that guides the mixed fluid to the workpiece passage region.

10 Claims, 6 Drawing Sheets

(51) Int. Cl.

| | |
|---|---|
| ***C25D 17/28*** | (2006.01) |
| ***C25D 17/22*** | (2006.01) |
| ***C23G 3/00*** | (2006.01) |
| ***C25D 5/12*** | (2006.01) |
| ***C25D 5/48*** | (2006.01) |
| ***C25D 5/08*** | (2006.01) |
| ***C25D 17/00*** | (2006.01) |
| ***C25D 17/18*** | (2006.01) |

(52) U.S. Cl.

CPC ..... *C25D 5/48* (2013.01); *C25D 17/001* (2013.01); *C25D 17/18* (2013.01); *C25D 17/22* (2013.01); *C25D 17/28* (2013.01); *C25D 21/08* (2013.01)

(56) References Cited

FOREIGN PATENT DOCUMENTS

| | | | |
|---|---|---|---|
| JP | 2007-191726 | A | 8/2007 |
| JP | 2017-095787 | A | 6/2017 |

* cited by examiner

PLATING APPARATUS AND PLATING METHOD

CROSS REFERENCE TO RELATED APPLICATIONS

This application claims the benefit of priority to Japanese Patent Application No. 2016-119564 filed on Jun. 16, 2016 and is a Continuation Application of PCT Application No. PCT/JP2017/019748 filed on May 26, 2017. The entire contents of each application are hereby incorporated herein by reference.

BACKGROUND OF THE INVENTION

1. Field of the Invention

The present invention relates to a plating apparatus and a plating method.

2. Description of the Related Art

In an electronic component, such as a chip multilayer capacitor, Ni plating and Sn Plating is typically performed on a surface of an external electrode included in the electronic component for the purpose of preventing solder corrosion and improving reliability of mounting by soldering.

When plating, such as the Ni plating and the Sn plating, is performed on the electronic component, a barrel plating method is frequently used as disclosed in Japanese Patent Application Laid-Open No. 10-212596.

In performing the barrel plating, a negative electrode terminal is disposed in a barrel to contact a group of objects to be plated in the barrel such that the object to be plated becomes a negative electrode, a positive electrode terminal is disposed outside the barrel so as to be immersed in a plating solution, and current is applied to both of the electrodes to make energization, thus plating the object to be plated.

However, in the conventional barrel plating method, non-uniformity of a current density distribution in the barrel is high, and a variation in thickness of the formed plating film is large.

SUMMARY OF THE INVENTION

Preferred embodiments of the present invention provide plating apparatuses and plating methods each capable of preventing the variation in thickness of the plating film.

According to a preferred embodiment of the present invention, a plating apparatus includes a plating tank in which a plating solution is stored; and a plating unit provided in the plating tank to perform electrolytic plating on an object to be plated. The plating unit includes a workpiece passage region in which at least a portion of the workpiece passage region is surrounded by a partition wall that allows passage of the plating solution but does not allow passage of the object to be plated, the object to be plated being passed from above toward below in the workpiece passage region; an injection unit that injects the plating solution from below toward above; a mixing unit above the injecting unit and below the workpiece passage region, the plating solution injected by the ejection unit and the object to be plated passed through the workpiece passage region being mixed in the mixing unit; an anode outside the workpiece passage region; a cathode inside the workpiece passage region and including a hollow region through which a mixed fluid of the plating solution and the object to be plated mixed by the mixing unit passes from below toward above; and a guidance unit that guides the mixed fluid passing through the hollow region of the cathode to the workpiece passage region.

The partition wall may surround the cathode, the anode may surround the partition wall, and the cathode, the partition wall, and the anode may be concentrically disposed. The partition wall, the mixing unit, the cathode, and the guidance unit may be structured to be separated from the plating apparatus as an integral unit.

The guidance unit may include a plating solution passage unit that allows the passage of the plating solution but does not allow the passage of the object to be plated.

According to a preferred embodiment of the present invention, a plating method includes (a) a step of guiding a mixed fluid including a plating solution and an object to be plated to a workpiece passage region in which at least a portion of the workpiece passage region is surrounded by a partition wall that allows passage of the plating solution but does not allow passage of the object to be plated; (b) a step of performing electrolytic plating on the object to be plated by applying voltage between an anode disposed outside the workpiece passage region and a cathode disposed inside the workpiece passage region when the object to be plated passes through the workpiece passage region from above toward below; and (c) a step of mixing an injected plating solution and the object to be plated passing through the workpiece passage region by injecting the plating solution from below toward above below the cathode, and of passing the mixed fluid of the plating solution and the object to be plated through a hollow region provided inside the cathode from below toward above.

The electrolytic plating may be performed on the object to be plated by repeating the steps (a), (b), and (c).

According to preferred embodiments of the present invention, electrolytic plating is performed while the object to be plated is passed through the workpiece passage region sandwiched between the anode and the cathode, so that satisfactory plating is able to be performed with a stable current density. Consequently, variations in thickness of the formed plating film are able to be prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

In the following description, a multilayer ceramic capacitor that is a representative chip electronic component is used as an object to be plated, and a plating apparatus used to perform electrolytic plating on an external electrode provided on a surface of the multilayer ceramic capacitor will be described.

Figure 1:
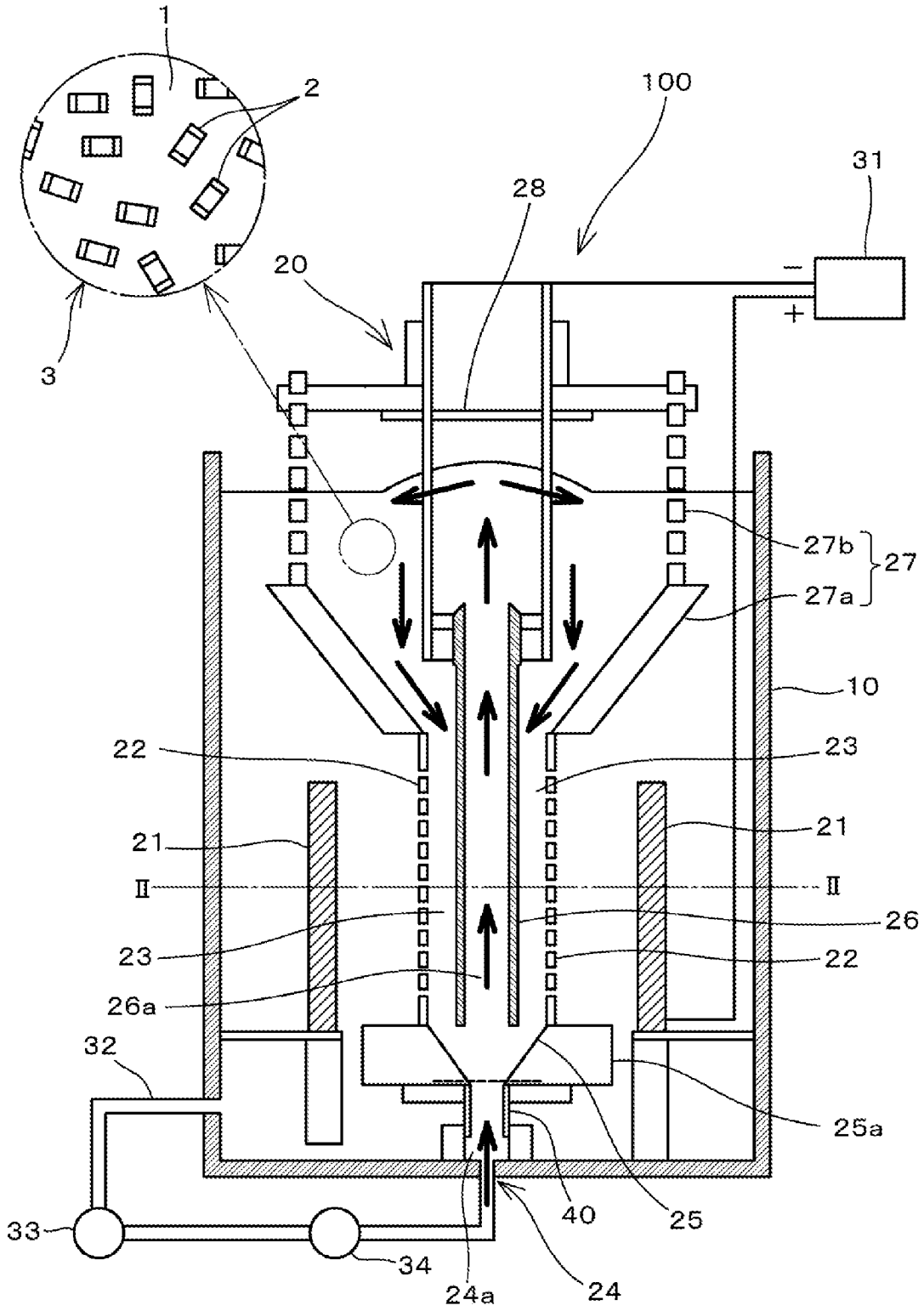
FIG. 1 is a front sectional view illustrating a plating apparatus according to a preferred embodiment of the present invention.
Figure 2:
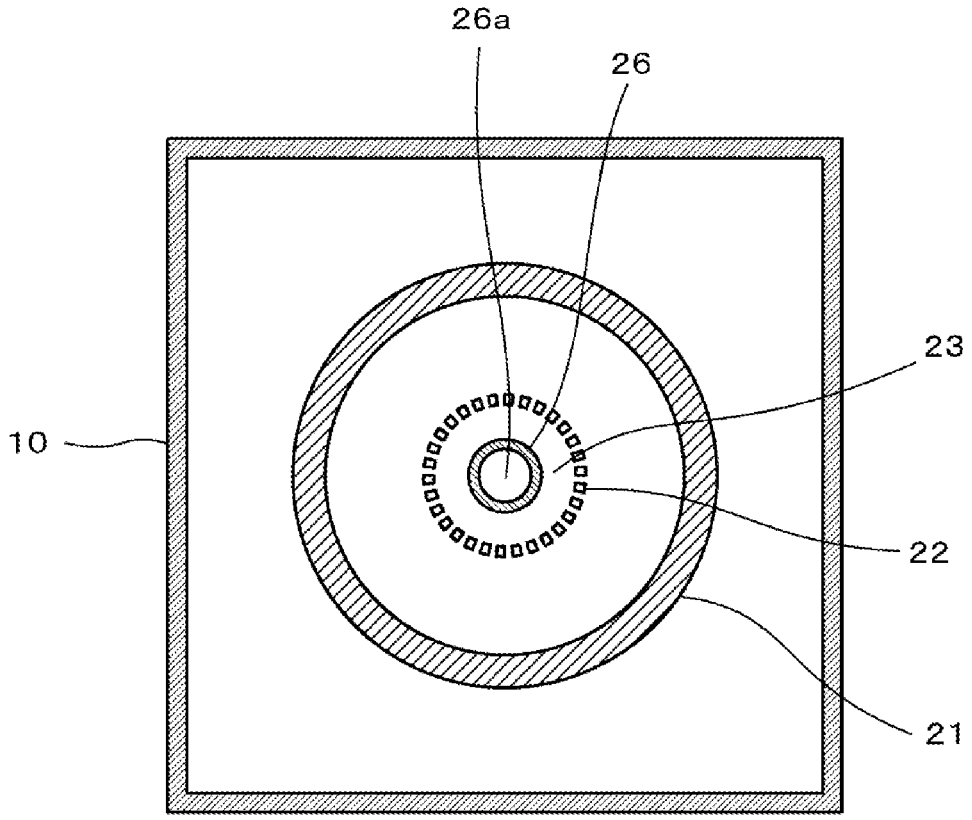
FIG. 2 is a sectional view taken along a line II-II in FIG. 1.

FIG. 1 is a front sectional view illustrating a plating apparatus 100 according to a preferred embodiment of the present invention, and FIG. 2 is a sectional view taken along a line II-II in FIG. 1.

As illustrated in FIGS. 1 and 2, the plating apparatus 100 includes a plating tank 10 that stores a plating solution 1 and a plating unit 20 that is provided in the plating tank 10 to perform the electrolytic plating on an object to be plated 2.

When the electrolytic plating is performed on the object to be plated 2, the plating solution 1 is stored in the plating tank 10 up to a position above an upper end of a cathode 26 (to be described later).

The plating unit 20 includes a workpiece passage region 23 in which at least a portion of the workpiece passage region 23 is surrounded by a partition wall 22 that allows passage of the plating solution 1 but does not allow passage of the object to be plated 2, the object to be plated being passed from above toward below in the workpiece passage region; an injection unit 24 that injects the plating solution 1 from below toward above; a mixing unit 25 disposed above the injection unit 24 and below the workpiece passage region 23 to mix the plating solution 1 injected by the injection unit 24 and the object to be plated 2 passing through the workpiece passage region 23; an anode 21 disposed outside the workpiece passage region 23; a cathode 26 disposed inside the workpiece passage region 23 and including a hollow region 26*a* through which a mixed fluid 3 of the plating solution 1 and the object to be plated 2 mixed by the mixing unit 25 passes from below toward above; and a guidance unit 27 that guides the mixed fluid 3 passing through the hollow region 26*a* of the cathode 26 to the workpiece passage region 23.

Voltage is applied from a power supply 31 to the anode 21 and the cathode 26. At this point, the anode 21 is used as a positive electrode, and the cathode 26 is used as a negative electrode.

The partition wall 22 defining the workpiece passage region 23 preferably has a cylindrical or substantially cylindrical shape, and is made of, for example, a mesh. As described above, the plating solution 1 is able to pass through the partition wall 22, but the object to be plated 2 cannot pass through the partition wall 22. In the present preferred embodiment, an upper portion and a lower portion of the partition wall 22 do not have liquid permeability. The workpiece passage region 23 is a region between the partition wall 22 and the cathode 26 (to be described later) disposed inside the partition wall 22.

The injection unit 24 includes a circulation line 32, a pump 33, and a filter 34.

The circulation line 32 is a flow channel of the plating solution 1 in order to inject the plating solution 1 in the plating tank 10 from an injection port 24*a* provided at a bottom of the plating tank 10.

The pump 33 is provided in the circulation line 32, and causes the plating solution 1 in the plating tank 10 to be injected from the injection port 24*a* through the circulation line 32.

The filter 34 removes foreign matter included in the plating solution 1 flowing through the circulation line 32.

The mixing unit 25 is disposed above the injection unit 24 and below the workpiece passage region 23 and the cathode 26. The mixing unit 25 preferably has a truncated cone shape in which a diameter of a top surface is larger than a diameter of a bottom surface. The diameter of the top surface is preferably greater than or equal to an inner diameter of a portion, which does not have liquid permeability and is provided below the partition wall 22. The diameter of the bottom surface is preferably equal or substantially equal to the diameter of the injection port 24*a* of the injection unit 24. The top surface of the mixing unit 25 is open and communicates with the workpiece passage region 23 and the hollow region 26*a* of the cathode 26. The bottom surface of the mixing unit 25 is also open and communicates with the injection port 24*a*. The truncated cone-shaped air gap defining the mixing unit 25 is formed by drilling a through hole corresponding to the truncated cone shape of the mixing unit 25 in a member 25*a* having the same or substantially the same thickness as a height dimension of the mixing unit 25.

The mixing unit 25 is a region in which a fluid including the object to be plated 2 and the plating solution 1 that passes through the workpiece passage region 23 while sinking, the fluid having high percentage of the sedimentation-thickening object to be plated 2, and the plating solution 1 injected upward from the injection port 24*a* are mixed together, and is a region in which a fluid including the object to be plated 2 at a high rate by the injection force of the plating solution 1 injected from the injection port 24*a* is mixed with the plating solution 1 in a process of guiding the fluid to the hollow region 26*a*.

The cathode 26 is preferably a metal pipe, for example, and disposed inside the workpiece passage region 23. The cathode 26 includes an inner hollow portion, and the inner hollow portion defines a hollow region 26*a* through which the mixed fluid 3 of the plating solution 1 and the object to be plated 2 pass from below toward above. The upper end of the cathode 26 is located above the upper end of the partition wall 22.

The anode 21 preferably has a cylindrical or substantially cylindrical shape, and is disposed outside the workpiece passage region 23. As illustrated in FIG. 2, the partition wall 22 surrounds the cathode 26, and the anode 21 surrounds the partition wall 22. As illustrated in FIG. 2, the cathode 26, the partition wall 22, and the anode 21 are concentric such that center axes of the cathode 26, the partition wall 22, and the anode 21 are aligned with one another.

That is, a region between an inner circumferential surface of the partition wall 22 and the outer circumferential surface of the cathode 26, which are concentrically surrounded, define the workpiece passage region 23. Consequently, current density is made uniform during the plating, and a uniform plating film is able to be formed. Because of the uniform current density, a region in which the current density exceeds the limiting current density does not exist as long as the current density is increased within a limiting current density range, so the current density is able to be set higher to enhance productivity.

In order to make the current density in the workpiece passage region 23 uniform, a mask member is provided between the partition wall 22 and the anode 21 so as to surround the lower portion of the workpiece passage region 23.

The guidance unit 27 includes a truncated cone unit 27*a* and a plating solution passage unit 27*b*. The plating solution passage unit 27*b* having an annular shape is provided on the truncated cone unit 27*a*, and is structured such that the plating solution 1 is able to pass through the plating solution passage unit 27*b* but the object to be plated 2 cannot pass through the plating solution passage unit 27*b*. The truncated cone unit 27*a* preferably has a truncated cone shape in which the top surface is larger than the bottom surface. The top and bottom surfaces of the truncated cone unit 27*a* are open surfaces, and a side surface of the truncated cone unit 27*a* is structured such that both of the plating solution 1 and the object to be plated 2 cannot pass through the side surface. The diameter of the bottom surface of the truncated cone unit 27*a* is preferably less than or equal to the inner diameter of a portion, which does not have liquid permeability and is above the partition wall 22. With this structure, in the mixed fluid 3 of the plating solution 1 and the object to be plated 2 injected from the upper end of the hollow region 26*a* of the cathode 26, the object to be plated 2 is able to be naturally guided to the workpiece passage region 23.

Above the cathode 26, a top plate 28 is provided such that the object to be plated 2 included in the mixed fluid 3 injected from the upper end of the hollow region 26*a* of the cathode 26 is prevented from jumping to the outside of the guidance unit 27.

Figure 3:
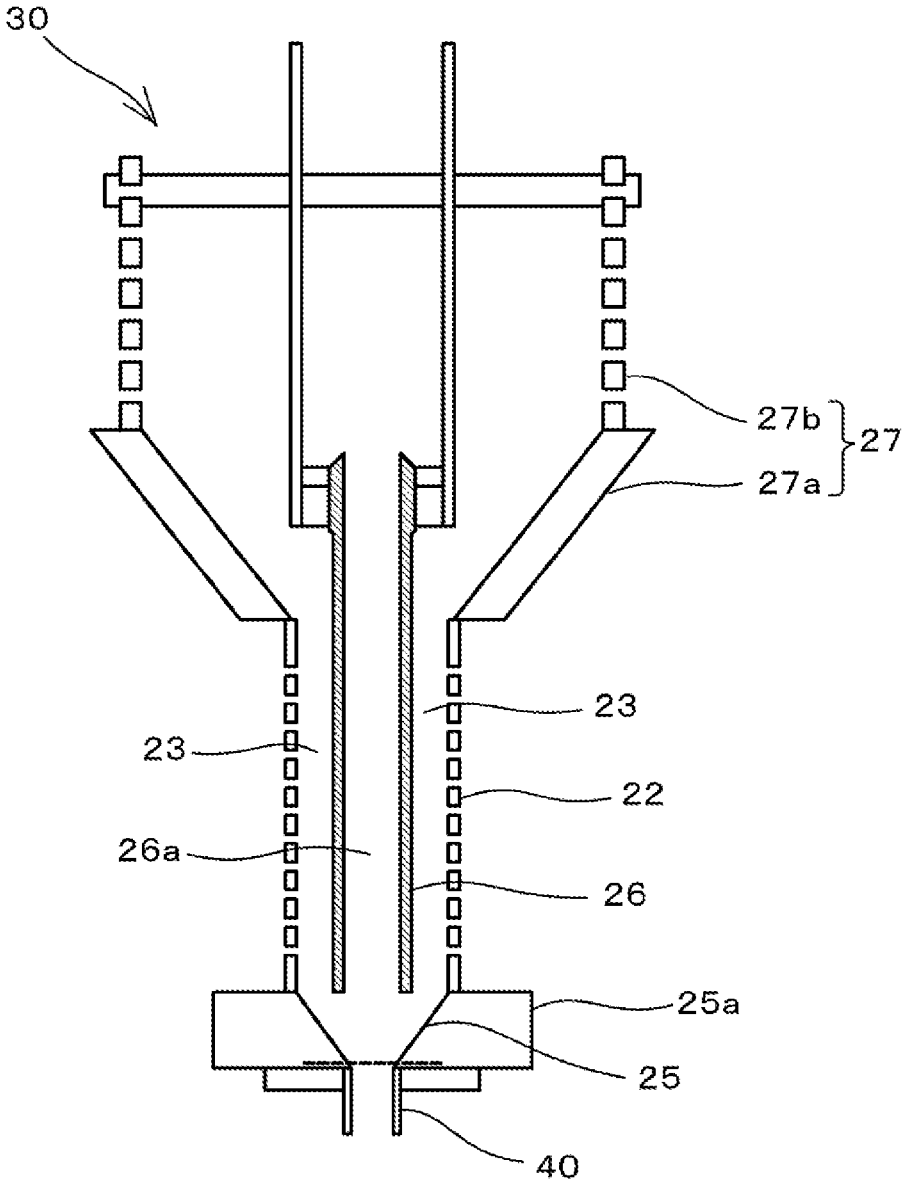
FIG. 3 is a view illustrating a separation unit including a partition wall, a mixing unit, a cathode, and a guidance unit.

As illustrated in FIG. 3, the partition wall 22, the mixing unit 25, the cathode 26, and the guidance unit 27 are structured to be separated from the plating apparatus 100 as an integral unit. Hereinafter, the partition wall 22, the mixing unit 25, the cathode 26, and the guidance unit 27 defining the separable integral unit, are also referred to as a separation unit 30.

Figure 4:
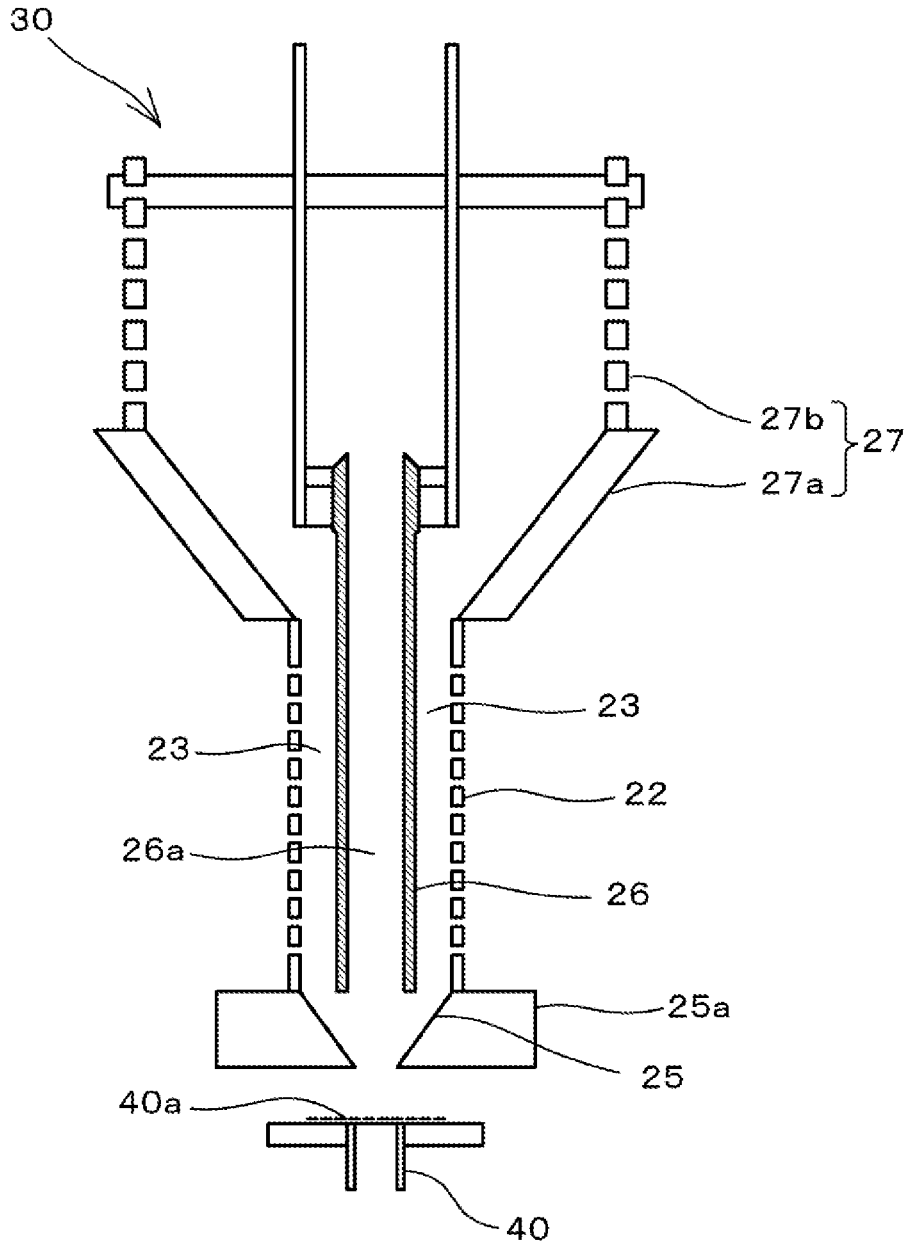
FIG. 4 is a view illustrating a state in which a leading end is detached from the separation unit.

As illustrated in FIG. 4, the lower portion of the separation unit 30, namely, a leading end 40 provided below the mixing unit 25 is able to be removed. A diaphragm 40*a*, through which the plating solution 1 is able to pass but the object to be plated 2 cannot pass, is provided at the leading end 40. While the object to be plated 2 is currently subjected to the plating, the object to be plated 2 does not drop in the injection port 24*a* because the diaphragm 40*a* is provided.

A method for performing the plating on the object to be plated 2 according to a preferred embodiment of the present invention using the plating apparatus 100 having the above-described configuration will be described below.

In a plating method according to a preferred embodiment of the present invention, the plating is performed on the object to be plated 2 by sequentially repeating the following steps: (a) a step of guiding the mixed fluid 3 of the plating solution 1 and the object to be plated 2 to the workpiece passage region 23 in which at least a portion of the workpiece passage region 23 is surrounded by the partition wall 22 that allows the passage of the plating solution 1 but does not allow the passage of the object to be plated 2, (b) a step of performing the electrolytic plating on the object to be plated 2 by applying a voltage between the anode 21 disposed outside the workpiece passage region 23 and the cathode 26 disposed inside the workpiece passage region 23 when the object to be plated 2 passes through the workpiece passage region 23 from above toward below, and (c) a step of mixing an injected plating solution 1 and the object to be plated 2 passing through the workpiece passage region 23 by injecting the plating solution 1 from below the cathode 26 toward above, and of passing the mixed fluid 3 of the plating solution 1 and the object to be plated 2 through the hollow region 26*a* provided inside the cathode 26 from below toward above.

The step (a) is a step of guiding the mixed fluid 3 of the plating solution 1 and the object to be plated 2 to the workpiece passage region 23 in the guidance unit 27. In the mixed fluid 3 of the plating solution 1 and the object to be plated 2 that passes through the hollow region 26*a* of the cathode 26, a portion of the plating solution 1 flows out to the outside of the guidance unit 27 through the plating solution passage unit 27*b*. While the object to be plated 2 included in the mixed fluid 3 sinks due to its own weight, and the object to be plated 2 is guided to the workpiece passage region 23 along the shape of the truncated cone unit 27*a*.

That is, in the mixed fluid 3 of the plating solution 1 and the object to be plated 2 injected from the upper end of the cathode 26, the object to be plated 2 is separated from the plating solution 1 by sedimentation. The object to be plated 2 is separated from the plating solution 1 without applying external force, so that scratching on the surface of the object to be plated 2 and other damage is prevented after the plating treatment. The guidance unit 27 includes the plating solution passage unit 27*b*, which allows a portion of the plating solution 1 included in the mixed fluid 3 to flow out to the outside of the guidance unit 27 through the plating solution passage unit 27*b* to quickly separate the plating solution 1 from the object to be plated 2.

In the step (b), the object to be plated 2 guided to the workpiece passage region 23 in the step (a) passes through the workpiece passage region 23 from above toward below. At this point, by applying voltage between the anode 21 and the cathode 26, the electrolytic plating is performed on the object to be plated 2 as it moves in the workpiece passage region 23.

More specifically, in the step (b), the object to be plated 2 guided to the workpiece passage region 23 is deposited in the workpiece passage region 23, and gradually lowered while deposited. As described above, the cathode 26, the partition wall 22, and the anode 21 are concentrically disposed such that the center axes of the cathode 26, the partition wall 22, and the anode 21 are aligned with one another, so that the stable and satisfactory plating is able to be performed on the object to be plated 2 passing through the workpiece passage region 23 with high uniformity of a current density distribution. Consequently, the variation in thickness of the plating film is prevented and a plating film having uniform thickness is formed.

As described above, the upper portion and the lower portion of the partition wall 22 do not have liquid permeability. The upper portion of the partition wall 22 does not have liquid permeability, which prevents an influence of the liquid flow from the truncated cone unit 27*a* disposed on the upper side of the workpiece passage region 23. The lower portion of the partition wall 22 does not have liquid permeability, which prevents an influence of the liquid flow of the plating solution 1 injected from below the workpiece passage region 23. Consequently, the object to be plated 2 is able to stably pass through the workpiece passage region 23.

In the step (c), the plating solution 1 in the plating tank 10 is injected from the injection port 24*a* through the circulation line 32 in the injection unit 24. The object to be plated 2 that passes through the workpiece passage region 23 is mixed with the plating solution 1 injected from the injection port 24*a* in the mixing unit 25 by suction force of a jet flow from the injection port 24*a*. At this point, the object to be plated 2 that is lowered while being deposited in the workpiece passage region 23 is loosened by shearing force of the jet flow from the injection port 24*a* in the mixing unit 25, and dispersed in the plating solution 1 to form the mixed fluid 3. By the jet flow from the injection port 24*a*, the mixed fluid 3 of the plating solution 1 and the object to be plated 2 passes through the hollow region 26*a* of the cathode 26 from below toward above, and is injected upward from the upper end of the hollow region 26*a*.

In this manner, in the injection unit 24, the plating solution 1 is injected from the injection port 24*a* by actuating the pump 33, such that the mixed fluid 3 of the plating solution and the object to be plated 2 is passed through the hollow region 26*a* of the cathode 26 and injected upward from the upper end of the hollow region 26*a*.

The mixed fluid 3 of the plating solution 1 and the object to be plated 2 that is injected upward from the upper end of the hollow region 26*a* is guided to the workpiece passage region 23 in the step (a).

Thereafter, the steps (a), (b), and (c) are repeated in this order, so that the electrolytic plating is performed on the object to be plated 2. Consequently, because the object to be plated 2 passes through the workpiece passage region 23 a plurality of times, the variation in thickness of the plating film in each object to be plated 2 is decreased, and the plating film having a desired thickness is able to be obtained.

As described above, according to the plating apparatus 100 of the present preferred embodiment, the object to be plated 2 flows in the vertical direction, so that the plating apparatus 100 has a vertically long shape. Thus, as compared with the conventional plating apparatus in which a rotating barrel including a rotating shaft in the horizontal direction is used, a floor area required to install the apparatus is able to be reduced, and area productivity is improved.

Additionally, because a driving source that fluidizes the object to be plated 2 includes only the pump 33 that fluidizes the plating solution 1, the structure of the plating unit 20 is simplified and the maintenance costs are reduced.

When the electrolytic plating is completed, the plated object to be plated 2 is cleaned. In order to clean the object to be plated 2, the separation unit 30, namely, the partition wall 22, the member 25*a* defining the mixing unit 25, the cathode 26, and the guidance unit 27 are removed, as an integral unit, from the plating tank 10. When the separation unit 30 is removed, the plating solution 1 flows out to the outside through the partition wall 22. On the other hand, the object to be plated 2 does not flow out to the outside, but remains in the workpiece passage region 23 and the mixing unit 25.

Figure 5:
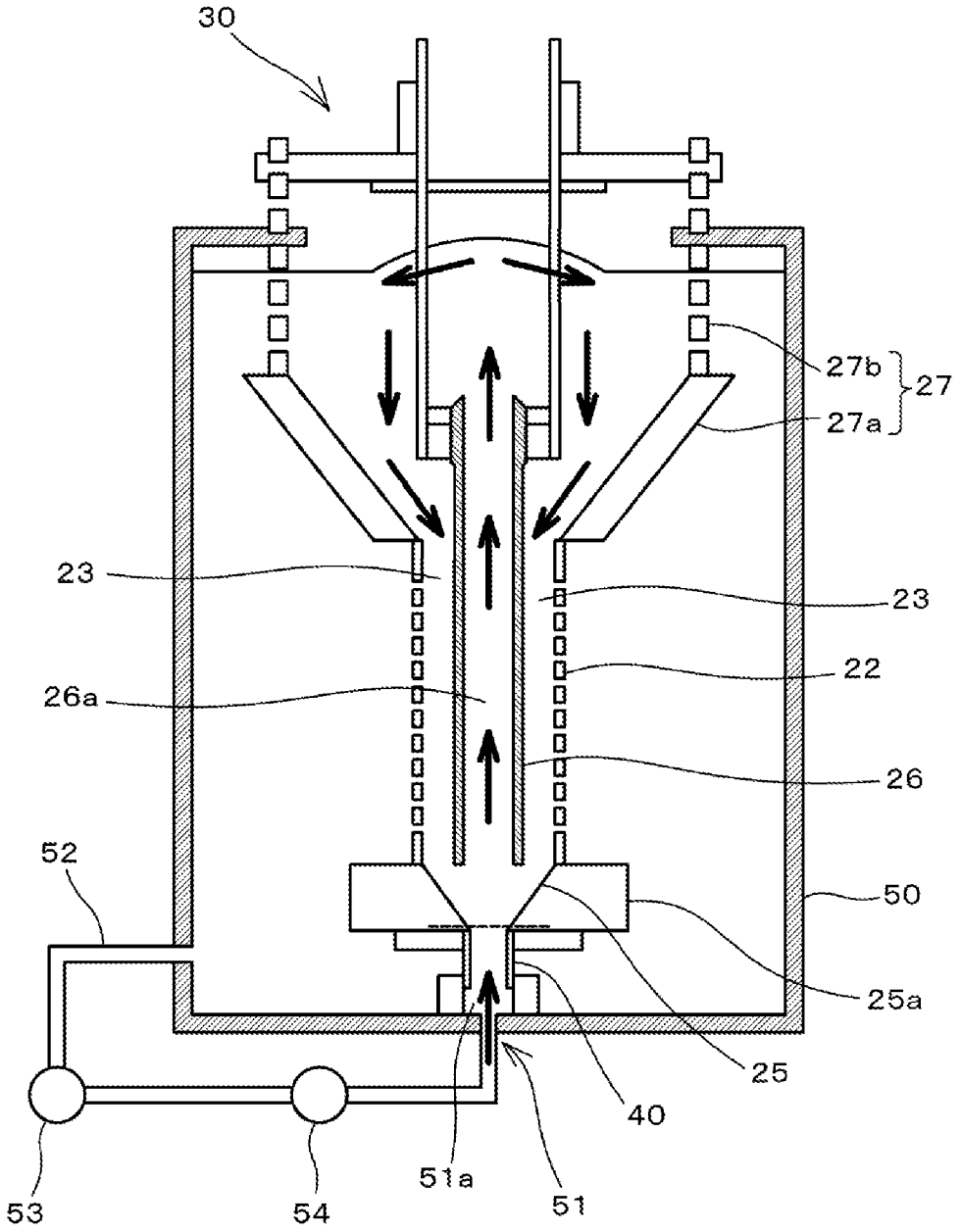
FIG. 5 is a view illustrating a state in which the separation unit is set in a cleaning tank in order to clean a plated object to be plated.

After the plating solution 1 flows out to the outside through the partition wall 22, the separation unit 30 is set in a separately-prepared cleaning tank 50 as illustrated in FIG. 5. Specifically, the leading end 40 of the separation unit 30 is connected to an injection port 51*a* provided at the bottom of the cleaning tank 50. In the cleaning tank 50, a cleaning solution is stored up to the position above the upper end of the cathode 26.

Although the injection unit 24 is provided in the plating apparatus 100 in FIG. 1, an injection unit 51 having the same or substantially the same configuration is also provided in the cleaning tank. The injection unit 51 includes a circulation line 52, a pump 53, and a filter 54 that removes the foreign matter.

During the cleaning of the plated object to be plated 2, the pump 53 is actuated to inject the cleaning solution in the cleaning tank 50 from an injection port 51*a* through the circulation line 52. Consequently, in the mixing unit 25, the cleaning solution injected from the injection port 51*a* and the object to be plated 2 are mixed and flow through the hollow region 26*a* of the cathode 26 from below toward above. In the mixed fluid of the cleaning solution and the object to be plated 2 that exits out from the upper end of the hollow region 26*a*, a portion of the cleaning solution passes through the plating solution passage unit 27*b* of the guidance unit 27, and flows to the outside of the guidance unit 27. Although the object to be plated 2 included in the mixed fluid sinks down due to its own weight, the object to be plated 2 is guided to the workpiece passage region 23 along a shape of the truncated cone unit 27*a* of the guidance unit 27 at that time.

The object to be plated 2 that moves from above toward below in the workpiece passage region 23 is mixed with the cleaning solution in the mixing unit 25, and flows again from below toward above in the hollow region 26*a* of the cathode 26. In this manner, the object to be plated 2 is cleaned while being circulated, which allows the object to be plated 2 to be cleaned in a short time.

Because the object to be plated 2 is able to be cleaned while cleaning liquid is circulated, a small amount of the cleaning liquid is able to be used, and an amount of drained cleaning liquid is reduced.

After the object to be plated 2 is cleaned, the separation unit 30 is moved upward, and the leading end 40 is removed, which allows the plated object to be plated 2 to be removed from below the mixing unit 25. Consequently, the plated object to be plated 2 is easily removed. Whether the object to be plated 2 remains in the partition wall 22 is able to be visually confirmed, so that the plating treatment is prevented from being performed on another type of an object to be plated while the object to be plated 2 remains in the separation unit 30.

Example 1

In Example 1 of a preferred embodiment of the present invention, a multilayer ceramic capacitor having a length of about 2.0 mm, a width of about 1.25 mm, and a thickness of about 1.25 mm, for example, was prepared as the object to be plated 2, and Ni plating and Sn plating were performed on the external electrodes of the multilayer ceramic capacitor. As described later, after the Ni plating was performed on the object to be plated 2, the Sn plating was performed on the object to be plated 2.

In the plating apparatus 100 having the configuration shown in FIGS. 1 and 2, a portion having liquid permeability in the cylindrical partition wall 22 was made of a mesh material of about 80 mesh, the diameter of the portion was about 70 mm, and the length of the portion was about 100 mm, for example. Portions which do not have the liquid permeability are located above and below the liquid-permeability portion, and the portions were defined by a pipe having the diameter of about 70 mm and the length of about 40 mm, for example.

A truncated cone unit 27*a* having an apex angle of about 90 degrees, for example, is provided above the partition wall 22. The diameter of the opening lower surface of the truncated cone unit 27*a* is equal or substantially equal to the diameter of the partition wall 22. The plating solution passage unit 27*b* made of a mesh material is disposed above the truncated cone unit 27. The mixing unit 25 having the apex angle of about 90 degrees, for example, was provided below the partition wall 22.

A stainless steel pipe having an outer diameter of about 35 mm and an inner diameter of about 25 mm, for example, was used as the cathode 26 disposed inside the partition wall 22.

The gap between the lower end of the pipe and the lower end of the mixing unit 25 having a truncated cone shape is several tens millimeters, and the upper end of the pipe is disposed near the center in the height direction of the truncated cone unit 27*a*. The pipe was suspended from above, and connected to the negative electrode of the power supply 31.

On the outside of the partition wall 22, a titanium anode case having an annular shape was disposed with a spacing of about 60 mm, for example, therebetween. A space that is able to be filled with a Ni chip was provided in the anode case, and the space was filled with the Ni chip. The anode case filled with the Ni chip was connected to the positive electrode of the power supply 31 to define the anode 21.

A Watt bath was used as the plating solution stored in the plating tank 10. As described above, the injection port 24*a* is provided at the bottom of the plating tank 10. The leading end 40 provided below the mixing unit 25 was mounted so as to be fitted in the injection port 24*a*. The plating solution was stored in the plating tank 10 up to a position above the upper end of the cathode 26.

By actuating the pump 33 of the injection unit 24, the plating solution 1 in the plating tank 10 is injected upward from the injection port 24*a* through the circulation line 32. The plating solution 1 injected from the injection port 24*a* passes through the hollow region 26*a* of the cathode 26, and is injected upward from the upper end of the cathode 26.

About 70000 multilayer ceramic capacitors as the object to be plated 2 and about 300 cc conductive medium having a diameter of about 1.5 mm, for example, were input to the plating tank 10, more specifically, to the inside of the plating solution passage unit 27*b* having an annular shape. The input object to be plated 2 sank, and was gradually lowered while deposited in the workpiece passage region 23. The object to be plated 2 was attracted to the mixing unit 25 by the jet flow of the plating solution 1 from the injection port 24*a*, mixed with the plating solution 1 in the mixing unit 25, and injected upward through the hollow region 26*a* of the cathode 26. In the mixed fluid 3 of the ejected plating solution 1 and the object to be plated 2, a portion of the plating solution 1 passed through the plating solution passage unit 27*b* of the guidance unit 27, flowed out to the outside of the guidance unit 27, and was injected from the injection port 24*a* through the circulation line 32. On the other hand, the object to be plated 2 was guided to the workpiece passage region 23 through the truncated cone unit 27*a* of the guidance unit 27 together with the other portion of the plating solution 1, namely, the plating solution 1 that does not flow out to the outside of the guidance unit 27, and gradually lowered in the workpiece passage region 23 while being deposited.

In this manner, while the object to be plated 2 was repeatedly circulated, the power supply 31 was turned on, energization was performed at about 24 A, for example, and the voltage was applied between the anode 21 and the cathode 26. The energization was made for about 90 minutes to supply a predetermined integrated current, and then the power supply 31 was turned off. The separation unit 30 was removed from the plating tank 10, and the plating solution 1 in the plating tank 10 was drained. Then, the separation unit 30 was immersed in the cleaning tank 50 filled with pure water used as a cleaning solution.

As described above, the injection port 51*a* is provided in the cleaning tank 50, and the leading end 40 of the separation unit 30 is connected to the injection port 51*a* to actuate the pump 53, such that the object to be plated 2 was cleaned while being circulated through the path of the workpiece passage region 23, the mixing unit 25, the hollow region 26*a* of the cathode 26, and the guidance unit 27. Then, the separation unit 30 was removed and moved to another cleaning tank, and the same washing process was performed. This washing treatment was repeated three times.

After the object to be plated 2 is cleaned, the separation unit 30 was immersed in the plating tank 10 filled with the Sn plating solution, and the Sn plating was performed on the object to be plated 2 by a procedure similar to the Ni plating. The condition that the anode 21 and the cathode 26 were energized was set to about 17 A for about 60 minutes, for example.

After the Sn plating was performed on the object to be plated 2, the object to be plated 2 was cleaned similarly to after the Ni plating.

Figure 6:
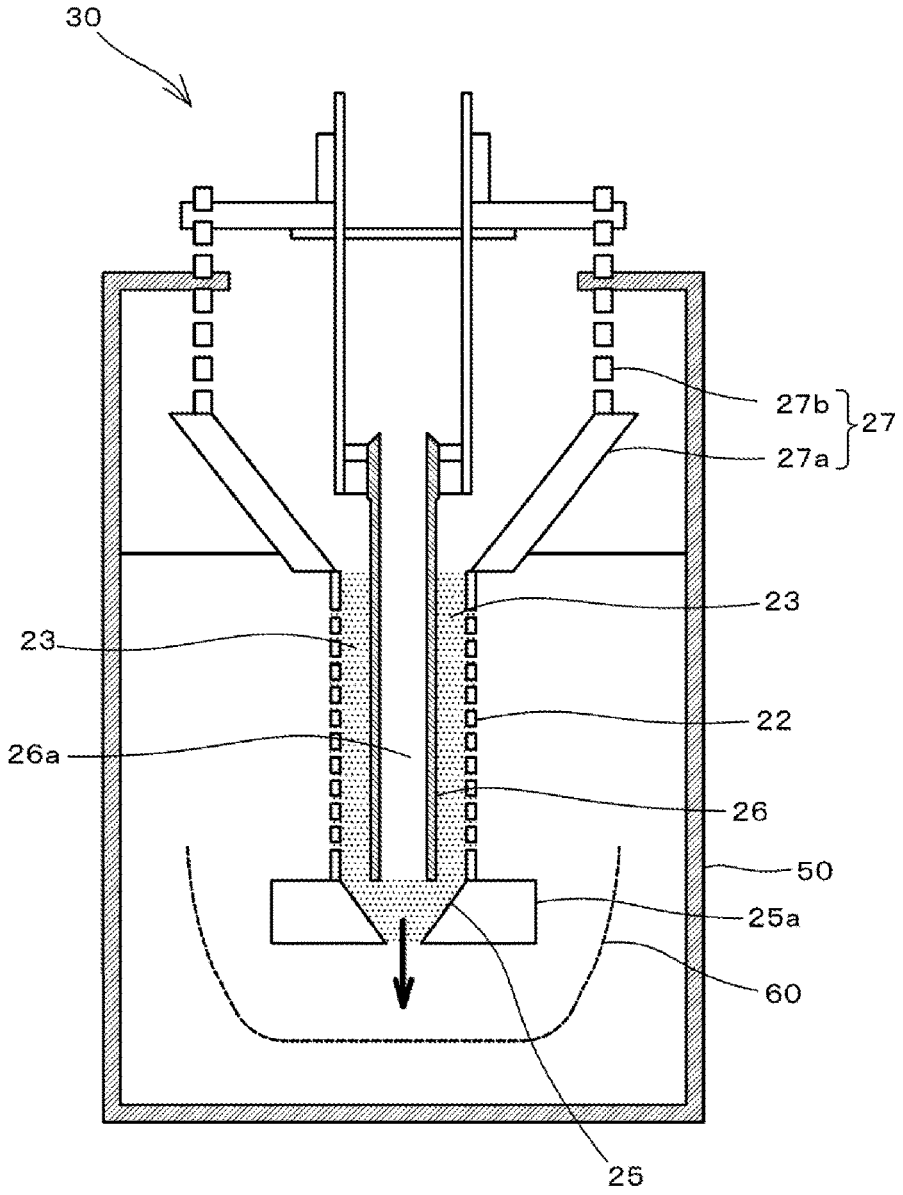
FIG. 6 is a view illustrating a method for removing the plated object to be plated.

After the cleaning of the object to be plated 2, as illustrated in FIG. 6, the separation unit 30 was removed from the injection port 51*a* of the cleaning tank 50 while the cleaning water was immersed at least up to the upper end of the partition wall 22, and a recovery container 60 made of a mesh material having a structure in which a main portion did not allow the passage of the object to be plated 2 but allowed the passage of the plating solution 1 was disposed below the removed separation unit 30. The leading end 40 (see FIGS. 3 and 4) provided below the separation unit 30 was removed. Consequently, the object to be plated 2 deposited in the workpiece passage region 23 and the mixing unit 25 sank and was recovered in the recovery container 60. At this point, the entire object to be plated 2 was recovered in the recovery container 60 by allowing the cleaning water to flow from above the separation unit 30.

As described above, the recovery container 60 included the liquid passage portion made of the mesh material which allowed the passage of the plating solution 1 but did not allow the passage of the object to be plated 2, so that the cleaning water could flow out to the outside of the recovery container 60 to recover only the plated object to be plated 2 when the recovery container 60 was moved upward.

After the object to be plated 2 was recovered in the recovery container 60, the separation unit 30 was moved upward and observed from above, which enables checking that the object to be plated 2 did not remain in the hollow region 26*a* of the cathode 26 and the workpiece passage region 23. The cathode 26 and the region holding the cathode 26 in the upper portion were removed, and the outer surface of the cathode 26 was observed to check whether the object to be plated 2 adhered thereto.

When the thickness of the Sn film of the object to be plated 2 recovered in the recovery container 60 was measured at 30 locations with a fluorescent x-ray film thickness meter, the average film thickness was about 3.95 μm, and CV (standard deviation/average value) was as good as about 6.7%. On the other hand, in the case that the plating film was formed by the conventional barrel plating method in which the rotating barrel was used, CV was greater than or equal to about 10% and less than or equal to about 15%. That is, with the plating apparatus 100 of the present preferred embodiment, the variation in thickness of the formed plating film is significantly decreased.

In the conventional barrel plating method in which the rotating barrel is used, a ridgeline of the object to be plated 2 is smoothed by scratching between the objects to be plated or collision between the object to be plated and the inner wall of the barrel. However, according to the plating method of Example 1, it was confirmed that the scratching did not occur by observing the surface of the Sn plating film, particularly the ridgeline. That is, with the plating apparatus 100 of the present preferred embodiment, impact force applied to the object to be plated 2 during the plating treatment is reduced.

In the conventional barrel plating apparatus in which the rotating barrel is used, the rotating barrel rotates around the horizontal axis. In order to avoid extreme concentration of current density, the anode is required to be disposed in parallel or substantially in parallel with the rotation axis at a position at which the anode stays at a predetermined distance from the barrel. For this reason, in the case of the conventional barrel plating apparatus in which the rotating barrel is used, the floor area of the plating tank is enlarged, for example, a floor area of about 500 mm in length×about 600 mm in width is required. On the other hand, with the plating apparatus 100 of the present preferred embodiment, the floor area of the plating tank 10 is, for example, about 300 mm in length×about 300 mm in width, and the floor area is reduced to less than or equal to about ⅓ as compared with the conventional barrel plating apparatus in which the rotating barrel is used.

As described above, in the plating apparatus 100 of the preferred embodiment, the partition wall 22, the mixing unit 25, the cathode 26, and the guidance unit 27 are structured to be define an integral unit that is able to be separated as the separation unit 30. Thus, after the plating treatment, the separation unit 30 is removed from the plating tank 10, and transferred to the cleaning tank 50, which enables easy cleaning of the object to be plated 2.

The cleaning is performed by circulating the object to be plated 2 in the cleaning tank 50, so that the cleaning is able to be performed in a short time. The uniformity of the cleaning solution in the cleaning tank is also achieved in a short time by circulating the cleaning solution, so that an excellent cleaning effect is obtained.

Example 2

In Example 2 of a preferred embodiment of the present invention, the Ni plating and the Sn plating were performed on the external electrodes of the multilayer ceramic capacitor having the length of about 4.5 mm, the width of about 3.2 mm, and the thickness of about 2.0 mm, for example, using the same plating apparatus 100 as that of Example 1. The presence or absence of cracking and chipping of the multilayer ceramic capacitor after the plating treatment was observed. The method for performing the Ni plating and the Sn plating was the same or substantially the same as Example 1.

Similarly to Example 1, the smoothing of the surface of the Sn film after the Sn plating was not observed, but the deposited Sn film remained. On the other hand, in the conventional barrel plating method in which the rotating barrel was used, the smoothing is produced at the ridgeline of the object to be plated, the Sn film was peeled off, and the inside external electrode was visible.

In either one of the plating method according to a preferred embodiment of the present invention and the conventional barrel plating method in which the rotating barrel is used, the cracking and the chipping were not observed when the appearance of 1000 plated objects to be plated were observed.

The plated object to be plated was returned to the plating apparatus again, a mixing treatment was additionally performed for about 10 hours, and the appearance of the object to be plated was observed. That is, the plated object to be plated using the plating apparatus 100 according to a preferred embodiment of the present invention was returned to the plating apparatus 100, the plated object to be plated by the conventional barrel plating method was returned to the rotating barrel, and the mixing treatment was performed. The mixing treatment is similar to the plating treatment, but the mixing treatment differs from the plating treatment in that the energization is not provided to the anode and the cathode.

When the mixing processing was performed in the rotating barrel, the chipping was generated in the ridgelines of three objects to be plated out of the 1000 objects to be plated. On the other hand, in the case that the mixing treatment was performed using the plating apparatus 100, the cracking and the chipping were not generated in any of the 1000 objects to be plated.

That is, in the plating apparatus 100, the external force applied to the object to be plated during the plating treatment is reduced, and the cracking and the chipping of the object to be plated were not generated.

In the above-described preferred embodiments, by way of example, the multilayer ceramic capacitor is used as the object to be plated, and the plating is performed on the external electrode. However, there is no particular limitation on a type of the object to be plated and the object that should be plated. For example, a laminated coil component may be used as the object to be plated, and the plating may be performed on the surface conductor of the laminated coil component.

In the above-described preferred embodiments, the cathode 26, the partition wall 22, and the anode 21 are concentrically disposed such that the center axes of the cathode 26, the partition wall 22, and the anode 21 are aligned with one another. However, the cathode 26, the partition wall 22, and the anode 21 are not necessarily concentrically disposed. For example, the center axis of each of the cathode 26, the partition wall 22, and the anode 21 may not be aligned with one another, or sectional shapes of the cathode 26, the partition wall 22, and the anode 21 in the horizontal direction may not be circular or substantially circular, and instead, may be an elliptical, for example. Even in such a configuration, the electrolytic plating is performed while the object to be plated 2 is passed through the workpiece passage region 23 sandwiched between the anode 21 and the cathode 26, which enables good plating with stable current density. Thus, the variation in thickness of the plating film is able to be prevented. However, when the cathode 26, the partition wall 22, and the anode 21 are concentrically disposed, the current density distribution is able to be more uniform during the plating, and the formed plating film is more uniform. Thus, preferably the cathode 26, the partition wall 22, and the anode 21 are concentrically disposed.

The present invention is not limited to the above-described preferred embodiments in other respects, but various applications and modifications may be made within the scope of the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A plating apparatus comprising:

a plating tank in which a plating solution is stored; and a plating unit provided in the plating tank to perform electrolytic plating on an object to be plated; wherein the plating unit includes:

a workpiece passage region in which at least a portion of the workpiece passage region is surrounded by a partition wall that allows passage of the plating solution but does not allow passage of the object to be plated, the object to be plated being passed from above toward below in the workpiece passage region;

an injector that injects the plating solution from below toward above;

a mixer above the injector and below the workpiece passage region to mix the plating solution injected by the injector and the object to be plated passing through the workpiece passage region;

an anode outside the workpiece passage region;

a cathode inside the workpiece passage region and including a hollow region through which a mixed fluid of the plating solution and the object to be plated mixed by the mixer passes from below toward above; and a guide that guides the mixed fluid passing through the hollow region of the cathode to the workpiece passage region;

the guide includes a plating solution passage that allows the passage of the plating solution but does not allow the passage of the object to be plated; and the guide is structured such that a top opening of the guide is larger than a bottom opening of the guide and side surfaces of the guide extend from the top opening to the bottom opening of the guide.

2. The plating apparatus according to claim 1, wherein the partition wall surrounds the cathode;

the anode surrounds the partition wall; and the cathode, the partition wall, and the anode are concentrically disposed.

3. The plating apparatus according to claim 1, wherein the partition wall, the mixer, the cathode, and the guide define an integral unit that is able to be separated from the plating apparatus.

4. The plating apparatus according to claim 1, wherein the partition wall has a cylindrical or substantially cylindrical shape.

5. The plating apparatus according to claim 1, wherein the partition wall is made of a mesh.

6. The plating apparatus according to claim 1, wherein the injector includes a circular line, a pump, and a filter.

7. The plating apparatus according to claim 1, wherein the mixer has a truncated cone shape including a top surface and a bottom surface; and the top surface has a diameter that is larger than a diameter of bottom surface.

8. The plating apparatus according to claim 1, wherein the cathode includes a metal pipe.

9. The plating apparatus according to claim 1, wherein the guide includes a truncated cone having a truncated cone shape and disposed below the plating solution passage.

10. The plating apparatus according to claim 1, wherein the partition wall includes an upper portion and a lower portion; and the upper portion and the lower portion do not have liquid permeability.

* * * * *